US009988243B2

(12) United States Patent
Cortona et al.

(10) Patent No.: US 9,988,243 B2
(45) Date of Patent: Jun. 5, 2018

(54) ELEVATOR SYSTEM

(71) Applicant: Inventio AG, Hergiswil (CH)

(72) Inventors: Elena Cortona, Zürich (CH); Frankie Schmid, Ebikon (CH)

(73) Assignee: INVENTIO AG, Hergiswil (CH)

( * ) Notice: Subject to any disclaimer, the term of this patent is extended or adjusted under 35 U.S.C. 154(b) by 0 days. days.

(21) Appl. No.: 15/103,029

(22) PCT Filed: Nov. 13, 2014

(86) PCT No.: PCT/EP2014/074465

§ 371 (c)(1),
(2) Date: Jun. 9, 2016

(87) PCT Pub. No.: WO2015/086251

PCT Pub. Date: Jun. 18, 2015

(65) Prior Publication Data

US 2016/0311655 A1 Oct. 27, 2016

(30) Foreign Application Priority Data

Dec. 9, 2013 (EP) ..... 13196230

(51) Int. Cl.
*B66B 11/02* (2006.01)
*B66B 9/00* (2006.01)

(52) U.S. Cl.
CPC ..... *B66B 11/022* (2013.01); *B66B 9/00* (2013.01)

(58) Field of Classification Search
CPC ..... B66B 11/022; B66B 9/00
See application file for complete search history.

(56) References Cited

U.S. PATENT DOCUMENTS 1,805,227 A * 5/1931 Rugg ..... B66B 5/0031 187/249
1,914,128 A * 6/1933 James ..... B66B 1/425 187/249
1,973,920 A * 9/1934 Wilson ..... B66B 9/00 187/249
2006/0163006 A1* 7/2006 Strebel ..... B66B 1/42 187/249
2006/0191747 A1* 8/2006 Mustalahti ..... B66B 1/42 187/249
2009/0301818 A1* 12/2009 Hashiguchi ..... B66B 11/0095 187/249

(Continued)

FOREIGN PATENT DOCUMENTS

EP 2444352 A1 4/2012
JP 2002302364 A 10/2002
JP 2007331871 A 12/2007

*Primary Examiner* — Michael A Riegelman
(74) *Attorney, Agent, or Firm* — William J. Clemens; Shumaker, Loop & Kendrick, LLP

(57) ABSTRACT

An elevator system includes an elevator car carrier moveable in a travel space to a plurality of floors. The elevator car carrier has a first elevator car and a second elevator car adjustably arranged thereon, as well as a drive unit. An adjustment device includes a first traction device and a second traction device, which traction devices are wound in the opposite sense onto drums of the drive unit. The distance between the first elevator car and the second elevator car can be adjusted by a rotation of the drums to adapt to varying floor distances.

13 Claims, 3 Drawing Sheets

(56) References Cited

U.S. PATENT DOCUMENTS

| | | | | |
|---|---|---|---|---|
| 2012/0097484 | A1* | 4/2012 | Cortona | B66B 11/022 187/249 |
| 2012/0152662 | A1* | 6/2012 | Husmann | B66B 11/022 187/401 |
| 2012/0318614 | A1* | 12/2012 | Husmann | B66B 1/42 187/249 |
| 2015/0122591 | A1* | 5/2015 | Kato | B66B 5/12 187/401 |
| 2015/0314990 | A1* | 11/2015 | Sen | B66B 11/022 187/254 |
| 2017/0121152 | A1* | 5/2017 | Zerelles | B66B 11/022 |

* cited by examiner

SECTION A-A

ELEVATOR SYSTEM

FIELD

The invention relates to an elevator system with at least one elevator car carrier, which can accommodate at least two elevator cars. More specifically the invention relates to the field of elevator systems configured as so-called double-decker elevator systems.

BACKGROUND

The JP 2007-331871 A has disclosed a double-decker elevator system. The known elevator comprises a car frame, in which two elevator cars are arranged vertically one above the other. Each of the two elevator cars is positioned on a carrier with rope pulleys. Furthermore the car frame has a drive unit arranged on it with a hoist rope running around it. The hoist rope is guided on one side around the rope pulleys of the carrier of the one elevator car and, on the other side, around the rope pulleys of the carrier of the other elevator car. By operating the hoist rope by means of the drive unit, the suspended elevator cars can be raised and lowered relative to the car frame. In this way it is possible to position the two elevator cars differently within the car frame.

The double-decker elevator known from the JP 2007-331871 A has the disadvantage that the drive unit arranged on the car frame requires a relatively large amount of space. This means that the drive unit must be sufficiently powerful because different tensile forces may be acting on the hoist rope on one side with the one elevator car and on the other side with the other elevator car. This may be due to, among others, a difference in loading of the two elevator cars. In addition there are large forces acting upon a traction sheave of the drive unit, when both elevator cars are loaded to a maximum. The drive unit must therefore be very powerful in order to be able to absorb the forces and torques occurring, including for maximum or extremely different loads, and to perform the desired adjusting movement.

SUMMARY

It is the requirement of the invention to propose an elevator system, which is characterized by an improved construction. Specifically, it is a requirement of the invention to propose an elevator system, where an adjustment of the elevator car arranged on the elevator car carrier is possible in an optimized manner and in particular, where the demands on the drive unit are reduced.

When designing the elevator system the elevator car carrier may be advantageously arranged in an elevator shaft, wherein a driving machine is provided which serves to operate the elevator car carrier. The elevator car carrier can thus be moved vertically along the envisaged travel path. The elevator car carrier may be suspended from a traction means or device connected to the elevator car carrier. The traction means may be guided in a suitable manner over a traction sheave of the driving machine. With this arrangement the traction means, apart from having the function of transferring the force or the torque of the driving machine to the elevator car carrier for operating the elevator car carrier, may also have the function of supporting the elevator car carrier. Operating the elevator car carrier is understood to mean, in particular, raising or lowering the elevator car carrier within the elevator shaft. To this end the elevator car carrier may be guided in one or more guide rails in the elevator shaft.

The adjustment device which serves to adjust the two elevator cars relative to the elevator car carrier may comprise, apart from a first traction means or device and a second traction means or device, further additional traction means. Specifically, instead of a single first traction means a number of traction means may be arranged in parallel. Correspondingly instead of a single second traction means, a number of traction means may be arranged in parallel. The traction means may be realized in the form of ropes, belts or the like. Apart from having the function of transferring the driving force or the driving torque of the drive unit to the two elevator cars, the traction means also have the function of supporting the two elevator cars. To this end the elevator car carrier may have one or more guide rails formed on it, which guide the two elevator cars on the elevator car carrier.

Advantageously the first traction means and the second traction means of the adjustment device may be wound in the opposite sense onto a first drum and a second drum, both driven by the drive unit. The two drums are preferably arranged on a common shaft driven by the drive unit. Thus only one moment, in essence, acts upon an electric motor of the drive unit, and any transverse forces occurring are minimized. This means that designing the drive unit can be simplified. When operating the drive unit the distance between the first elevator car and the second elevator car can be adjusted by a rotation of the drums. As the drums rotate, the elevator cars are moved in opposite directions.

The term "pulley" is to be understood in a general sense. A pulley may be formed of one or more parts. The pulley may be realized in the form of a sheave, in particular a driving sheave.

The term "drum" is to be understood in a general sense. A drum may be formed of one or more parts. The drum may be realized in the form of a cylindrical body, in particular for winding a traction means onto it. With this arrangement one end of a traction means is attached to the drum. When the drum rotates in a first direction, the traction means is wound onto it, and when it rotates in a second direction contrary to the first direction, the traction means is wound off again.

It is advantageous that the first elevator car is arranged below the second elevator car. Preferably the drive unit is arranged on the elevator car carrier, in particular attached in a fixed position to the elevator car carrier. Further it is advantageous that the drive unit is arranged on a cross member of the elevator car carrier. It is further advantageous that the drive unit is arranged above the second elevator car on the elevator car carrier. Specifically the cross member on which the drive unit is arranged, may be positioned above the two elevator cars. Advantageously, this permits a reversal of the two traction means to the drums of the drive unit.

Furthermore it is advantageous that the first elevator car has a first longitudinal side and a second longitudinal side facing away from the first longitudinal side, that the second elevator car has a first longitudinal side and a second longitudinal side facing away from the first longitudinal side, that the first traction means on one side is guided between the first drum and the first end of the first traction means along the second longitudinal side of the first elevator car and past the second elevator car to the first elevator car, and in that the second traction means on the other side is guided between the first drum and the first end of the second traction means to the second elevator car. This makes a compact rope guidance possible.

It is also advantageous that the first traction means on one side, is guided between the first drum and the first end of the first traction means, at least in sections, along the second longitudinal side of the first elevator car and that the second traction means on the other side, is guided between the second drum and the first end of the second traction means, at least in sections, along the first longitudinal side of the second elevator car. This means that the two traction means can be advantageously guided along the two elevator cars. As a result the space provided for the elevator cars within the elevator car carrier can be utilized in an advantageous manner for the two elevator cars. It also means that the available cross-section in the elevator shaft can be utilized in an advantageous manner.

Besides it is advantageous that the first end of the first traction means is connected to the first elevator car in the area of an underside of the first elevator car, and that the first end of the second traction means is connected to the second elevator car in the area of an underside of the second elevator car. Both traction means can thus be attached to the two elevator cars in an advantageous manner. In addition, due to this attachment, the two traction means can be guided relatively closely along the two elevator cars, resulting in a compact construction.

Alternatively it is possible to connect the first end of the first traction means to the first elevator car in the area of its topside and to connect the first end of the second traction means to the second elevator car in the area of its topside. In comparison to the previously described attachment this makes it possible to use particularly short traction means.

It is advantageous that the adjustment device comprises a first pulley, that the first traction means between the first drum and the first end of the first traction means is guided over a first pulley, that the adjustment device comprises a second pulley, and that the second traction means between the second drum and the first end of the first traction means is guided over the second pulley. With this arrangement the first pulley and the second pulley may be arranged in an advantageous manner on the cross member of the elevator car carrier, to which the drive unit is also attached. With this arrangement the drive unit may be arranged between the two pulleys in an advantageous manner. This allows the two traction means to be guided in an advantageous manner, wherein the two traction means are passed around the first and second drums resp. in the opposite sense. The drive unit can thus be relieved from any forces which it might be subjected to.

Another advantage is the fact that the first traction means is wound from below around the first drum and that the second traction means is wound from below around the second drum. Alternatively the first traction means may be wound from above around the first drum and the second traction means may be wound from above around the second drum. This allows for an advantageous suspension of the two elevator cars on the two traction means. Specifically this results in an advantageous equilibrium of forces. The two traction means can thus be advantageously driven contrary to each other. With this arrangement the two traction means are passed around the first and second drums in the opposite sense.

Advantageously provision is made for a further adjustment device, wherein the further adjustment device comprises third and fourth drums arranged on the elevator car carrier, a third traction means which can be wound onto the third drum, and a fourth traction means which can be wound in the opposite sense to the third traction means onto the fourth drum, wherein a first end of the third traction means of the further adjustment device is connected, at least indirectly, to the first elevator car, wherein a second end of the third traction means of the further adjustment device is connected to the third drum, wherein a first end of the fourth traction means of the further adjustment device is connected, at least indirectly, to the second elevator car, wherein a second end of the fourth traction means of the further adjustment device is connected to the fourth drum and wherein the third and fourth drums of the further adjustment device can be driven in the same way as defined for the first and second drums of the adjustment device.

Specifically the third and fourth drums of the further adjustment device may be driven by the drive unit of the adjustment device. This allows one drive unit to be used for operating the two adjustment devices. Due to the further adjustment device an advantageous suspension of the two elevator cars in the elevator car carrier can be achieved.

Advantageously the third traction means is wound from below around the third drum and the fourth traction means is wound from below around the fourth drum. Alternatively it is also advantageous for the third traction means to be wound from below around the third drum, and for the fourth traction means to be wound from below around the fourth drum. In this way the two traction means can be advantageously driven contrary to each other. With this arrangement the two traction means are passed around the third and fourth drums in the opposite sense.

In a particular advantageous manner the first and second traction means are each wound from below around the first and second drums and the third and fourth traction means are each wound from above around the third and fourth drums, or the first and second tractions means are each wound from above around the first and second drums and the third and fourth tractions are each wound from below around the third and fourth drums. This permits a particularly advantageous suspension of the first and second elevator cars, wherein a respective elevator car, with respect to its point of gravity, is symmetrically suspended from the first and fourth or second and third traction means.

DESCRIPTION OF THE DRAWINGS

Preferred exemplary embodiments of the invention are explained in detail in the description below by way of the attached drawings, in which.

DETAILED DESCRIPTION

Figure 1A:
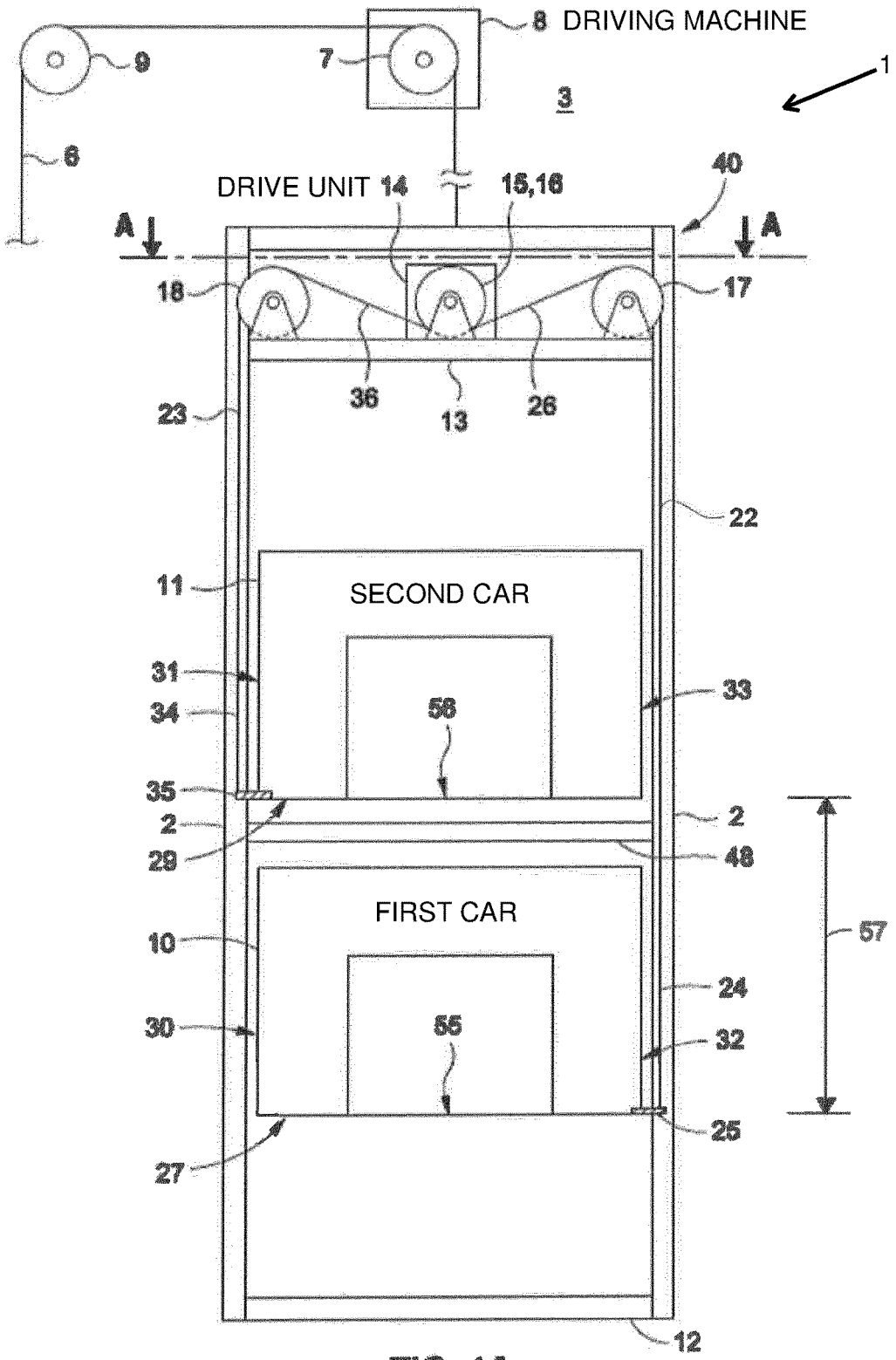
FIG. 1A shows a schematic diagram of part of an elevator system corresponding to an exemplary embodiment of the invention.

FIG. 1A shows an elevator system 1 with at least one elevator car carrier 2, which is movable within in a travel space 3 provided for a ride of the elevator car carrier 2. The travel space 3 may, for example, be provided in an elevator shaft of a building.

The elevator car carrier 2 is suspended from one end of the traction mean 6. Further, the traction means 6 is passed around a traction sheave 7 of a driving machine 8 and a guide pulley 9. The driving machine 8 is arranged in the elevator shaft. Corresponding to a momentary direction of rotation of the traction sheave 7 the elevator car carrier 2 is moved in an upward or downward direction through the travel space 3. Alternatively the elevator car carrier 2 may be suspended via a centrally arranged rope pulley or several rope pulleys from the traction means 6 in a suspension ratio of 2:1. It goes without saying that depending on requirements for the elevator system 1 the expert may wish to realize higher suspension ratios.

A first elevator car 10 and a second elevator car 11 are adjustably arranged on the elevator car carrier 2. The first elevator car 10 is arranged below the second elevator car 11. The first elevator car 10 has a first longitudinal side 30 and a second longitudinal side 32, which faces away from the first longitudinal side 30. In addition the second elevator car 11 has a first longitudinal side 31 and a second longitudinal side 33, which faces away from the first longitudinal side 31. The elevator car carrier 2 has a lower cross member 12 and an upper cross member 13. The upper cross member 13 is arranged in a fixed position on the elevator car carrier 2. The upper cross member 13 has a drive unit 14 attached to it, which serves to drive a first and a second drum 15, 16. The first and the second drums 15, 16 are connected to the drive unit 14 via a common shaft. Alternatively the first and second drums 15, 16 may each be separately connected to the drive unit 14 via their own shaft. The drive unit 14 with the two drums 15, 16 is thus arranged above the second elevator car 11 on the upper cross member 13.

In addition the upper cross member 13 has a first pulley 17 and a second pulley 18 arranged on it. The first and second drums 15, 16 of the drive unit 14 are arranged between the first pulley 17 and the second pulley 18.

Moreover the elevator car carrier 2 has a first traction means 22 and a second traction means 23 arranged on it. A first end 24 of the first traction means 22 is guided along the second longitudinal side 33 of the second elevator car 11 past the second elevator car 11 to the first elevator car 10. On the second longitudinal side 32 of the first elevator car 10 the first end 24 of the first traction means 22 is connected to the first elevator car 10 at an attachment point 25 in the area of an underside 27 of the first elevator car 10. Furthermore a second end 26 of the first traction means 22 is connected at an attachment point to the first drum 15. The first traction means 22 is guided on one side over the first pulley 17. Between the first pulley 17 and the first drum 15 the first traction means 22 is wound from below around the first drum 15.

A first end 34 of the second traction means 23 is connected on the first longitudinal side 31 of the second elevator car 11 to the second elevator car 11 at an attachment point 35 in the area of the underside 29. Furthermore a second end 36 of the second traction means 23 is connected at an attachment point to the second drum 16. The second traction means 23 is guided over the second pulley 18. Between the second pulley 18 and the second drum 16 the second traction means 23 is wound from below around the drum 16.

The first elevator car 10 and the second elevator car 11 are advantageously suspended within the elevator car carrier 2 via the traction means 22, 23. The first traction means 22 and the second traction means 23 are wound in the opposite sense around the first and the second drum 15, 16 respectively. When the first and the second drums 15, 16 are operated by the drive unit 14, the first traction means 22 and the second traction means 23 move past each other in opposite directions.

An adjust means 40 is thus configured, which serves to adjust the two elevator cars 10, 11 relative to the elevator car carrier 2 and relative to each other. The adjust means 40 comprises the first and second drums 15, 16 driven by the drive unit 14, the first pulley 17 and the second pulley 18 as well as the first traction means 22 and the second traction means 23.

The first elevator car 10 has an exit level 55. Further the second elevator car 11 has an exit level 56. The exit levels 55, 56 have a distance 57 from each other. The distance 57 between the elevator cars 10, 11 can be varied via the drive unit 14 and the adjustment device 40. Depending on the direction of rotation of the first and second drums 15, 16 the distance 57 is increased or decreased within certain limits. For example, within a building the distance between floors may vary. In particular a floor distance in relation to a lobby may be larger than a floor distance provided otherwise. For example, based on a minimum distance 57, a distance 57 between the elevator cars 10, 11 may be increased by up to 3 m.

In the starting position shown in FIG. 1A the underside 29 of the second elevator car 11 is in the area of a central cross member 48 of the elevator car carrier 2. A further lowering of the second elevator car 11 relative to the elevator car carrier 2 is therefore not possible. The shown distance 57 therefore indicates a predefined minimum distance 57. The minimum distance 57 can be set within certain limits via the length of the traction means 22, 23.

To raise the second elevator car 11 relative to the elevator car carrier 2, the first and second drums 15, 16 are driven by the drive unit 14. In this exemplary embodiment, in order to raise the second elevator car 11, the second drum 16 needs to be driven anti-clockwise. This has the effect of shortening that part of the second traction means 23, which on one side is between the second pulley 18 and the attachment point 35. Since both traction means 22, 23 are wound in the opposite sense respectively around the first and second drums 15, 16, the effect as regards the first traction means 22 is exactly the opposite. For the first traction means 22 moves contrary to the second traction means 23. This has the effect of lengthening that part of the first traction means 22, which on one side is between the first pulley 17 and the attachment point 25.

In summary, the first elevator car 10 is lowered from the starting position shown in FIG. 1A, whilst the second elevator car 11 is raised from the starting position shown in FIG. 1A. As a result the distance 57 between the first elevator car 10 and the second elevator car 11 increases. Moreover an adjustment path of the first elevator car 10 is at least approximately equal to an adjustment path of the second elevator car 11. Further, the two elevator cars 10, 11 are adjusted in opposite directions relative to each other. For an increase in the distance 57 the first elevator car 10 is adjusted downwards and the second elevator car 11 it adjusted upwards.

Vice versa, when the first and second drums 15, 16 are driven in the opposite direction, that is clockwise, the second elevator car 11 is lowered, whilst the first elevator car 10 is raised. As a result the distance 57 decreases again.

Thus, within certain limits, a variation of the distance 57 is achieved by operating the first and second drums 15, 16 by means of the drive unit 14. In this way the distance 57 can be adapted to the respectively predefined floor distance of the target floors.

Tensile forces act upon the first traction means 22 and the second traction means 23 on the first and second drums 15, 16 in an advantageous manner. These tensile forces result in particular from the weight forces of the elevator cars 10, 11. At this point the forces of the two elevator cars 10, 11 are advantageously in equilibrium. The one elevator car 10 acts as a counterweight for the other elevator car 11. Thus the drive unit 14 has to apply, at least in essence, a torque only upon the traction means 22, 23, which is sufficient to overcome the unbalanced weight force between the two elevator cars 10, 11 as well as the friction forces of the system.

The drive unit 14 can drive the first and second drums 15, 16 only via a worm gear. The drive unit 14 is then connected via a worm gear to the first and second drums 15, 16. This allows even small movements of the traction means 22, 23 to be achieved in a reliable manner. As a result small operating paths of the elevator cars 10, 11 for altering the distance 57 can be achieved. Specifically the drive unit 14 with the first and second drums 15, 16 can be laid out such that for a normal rotational speed of the drive unit 14 even small adjustment movements of the elevator cars 10, 11 relative to the elevator car carrier 2 are possible. In this way a 1:1 adjustment is rendered possible by the adjustment device 40, where the friction loss occurring is small and relatively short traction means 22, 23 are sufficient.

The drive unit 14 may thus be of a relatively small size and comprise an optimized performance. With respect to the performance of the drive unit 14, relatively large adjustment paths, in particular of two or more meters, may be realized between the two elevator cars 10, 11.

Advantageously a 1:1 suspension operated by a small motor of the drive unit 14 may be realized. For example the capacity of the drive unit 14 may be in the range between 2 kW and 5 kW. This means that elevator cars 10, 11 may be operated, which have a mass of 2250 kg each. The resulting range of applications for the elevator system 1 is therefore quite large.

Alternatively higher suspension ratios of 2:1, 3:1 or even higher can be realized.

Figure 1B:
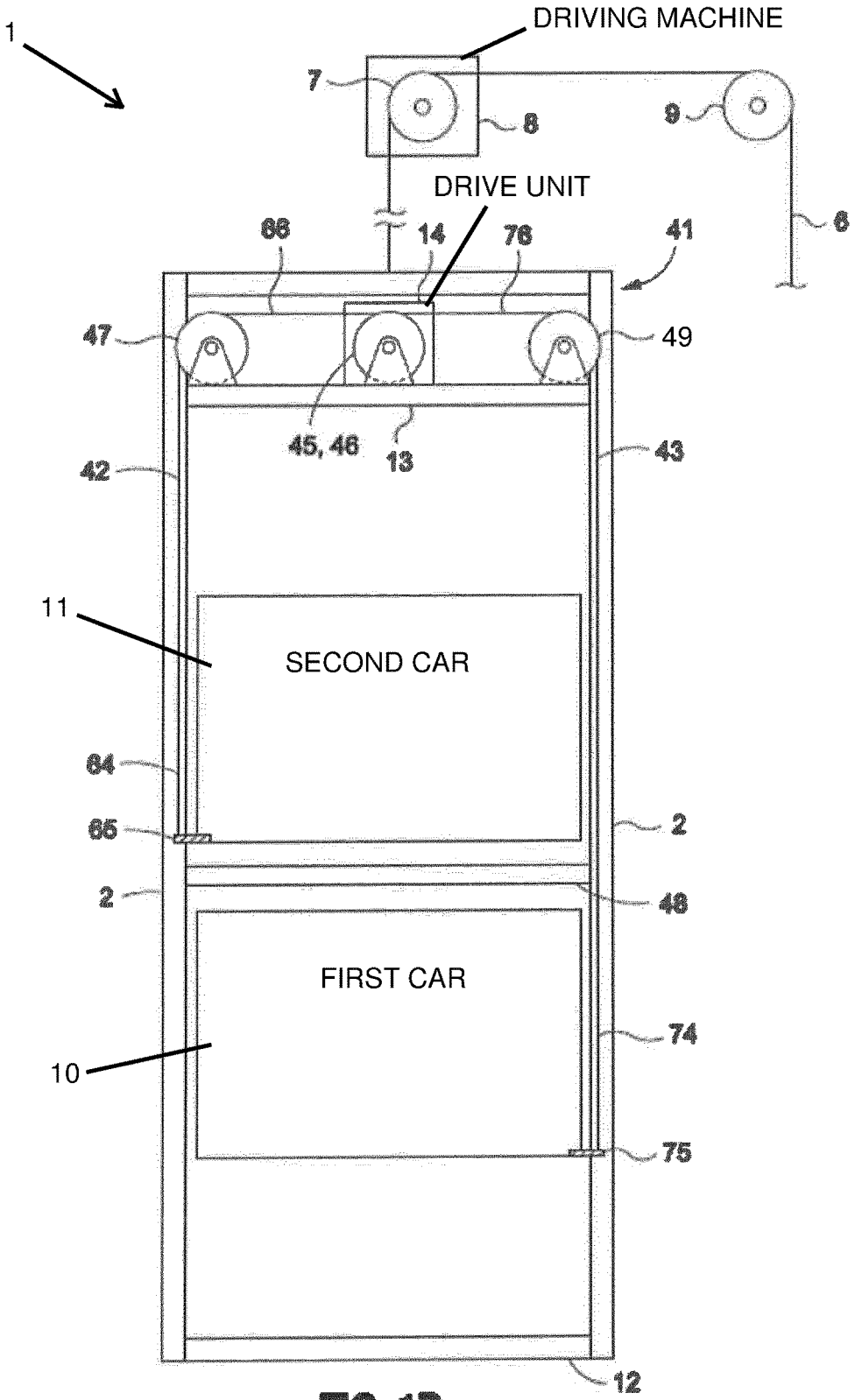
FIG. 1B shows a schematic diagram of part of an elevator system corresponding to an optional realization of the embodiment.
Figure 2:
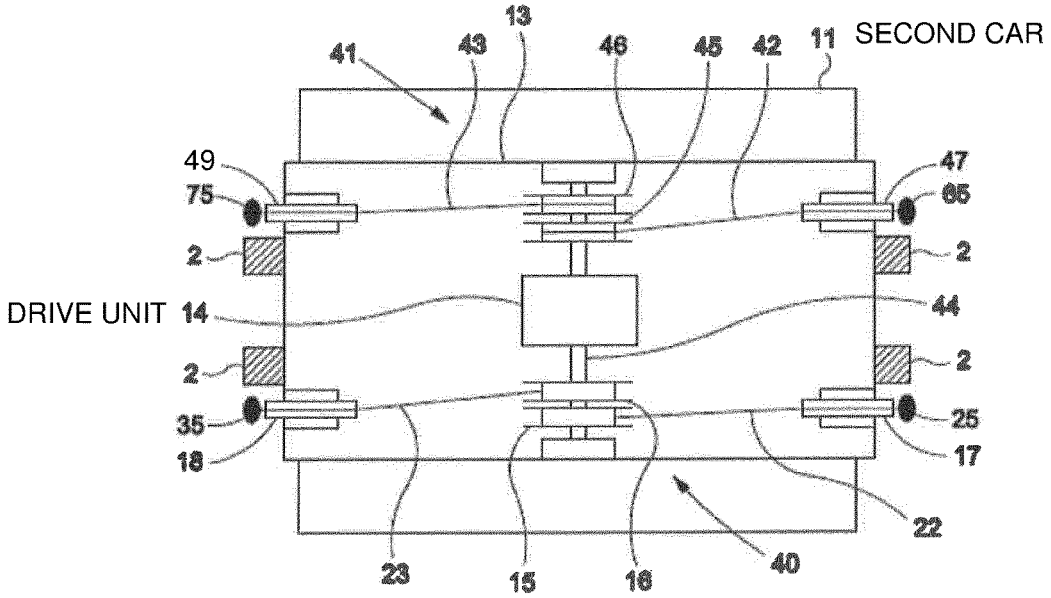
FIG. 2 shows a schematic top view of part of an elevator system corresponding to the optional realization of the embodiment.

Further according to FIGS. 1B and 2 a further adjustment device 41 may be provided. FIG. 1B shows a view of the further adjustment device 41 of the elevator system, which is opposite to that shown in FIG. 1A. FIG. 2, in a section A-A from FIG. 1A, shows both the adjustment device 40 and the further optional adjustment device 41 in a top view. The further adjustment device 41 may essentially be configured in the same way as the adjustment device 40 and in essence operates in the same way as described before for the adjustment device 40 for adjusting the distance 57 between the elevator cars 10, 11. In particular a third traction means 42 and a fourth traction means 43, a third and a fourth drum 45, 46 as well as a third and a fourth pulley 47, 49 may be provided.

In a preferred embodiment of the further adjustment device 41 a first end 64 of the third traction means 42 is connected on one side at an attachment point 65 to the second elevator car 11 and a second end 66 is connected at an attachment point to the third drum 45, and on the other side, a first end 74 of the fourth traction means 43 is connected at an attachment point 75 to the first elevator car 10 and a second end 76 of the fourth traction means 43 is connected at an attachment point to the fourth drum 46.

Similarly to the first adjustment device 40 the third and the fourth traction means 42, 43 are wound in opposite directions around the third and the fourth drum 45, 46, respectively, wherein the third and the fourth traction means are wound from above, respectively, around the third and the fourth drum 45, 46. In interaction with the winding direction of the first and second traction means 22, 23, which are respectively wound from below around the first and the second drum 15, 16, this results in a particularly simple concordant transfer of the torque from the drive unit 14 to the first, second, third and fourth drums 15, 16, 45, 46 for a simultaneously advantageous symmetrical suspension (with regard to a respective point of gravity) of the first and the second elevator cars 10, 11 on the elevator car carrier 2.

A connection shaft 44 may connect the drive unit 14 with the adjustment device 41. In this way the drive unit 14 may serve to drive both the components of the adjustment device 40 and the components of the further adjustment device 41. Thus, the first traction means 22 and the second traction means 23 of the adjustment device 40 on the one hand, as well as the third traction means 42 and the fourth traction means 43 of the further adjustment device 41 on the other, may be operated via the drive unit 14.

Moreover the third traction means 42 is guided from the third drum 45 to the attachment point 65 on the second elevator car 11 via the third pulley 47, and the fourth traction means 43 is guided from the fourth drum 46 to the attachment point 75 on the first elevator car 10 via the fourth pulley 49.

The invention is not restricted to the embodiments described.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system comprising:

an elevator car carrier that moves within a travel space;

a first elevator car adjustably arranged on the elevator car carrier;

a second elevator car adjustably arranged on the elevator car carrier;

a drive unit arranged on the elevator car carrier; and an adjustment device including a first traction means and a second traction means wound in opposite directions onto a drum driven by the drive unit whereby a distance between the first elevator car and the second elevator car is adjusted by a rotation of the drum by the drive unit, wherein the drum includes a first drum and a second drum, a first end of the first traction means is connected to the first elevator car, a second end of the first traction means is connected to the first drum, a first end of the second traction means is connected to the second elevator car, and a second end of the second traction means is connected to the second drum.

2. The elevator system according to claim 1 wherein the rotation of the drum causes the elevator cars to move in opposite directions in the elevator car carrier.

3. The elevator system according to claim 1 wherein the first elevator car has a first longitudinal side and a second longitudinal side facing away from the first longitudinal side, the second elevator car has a first longitudinal side and a second longitudinal side facing away from the first longitudinal side, the first traction means is guided between the first drum and the first end of the first traction means along the second longitudinal side of the second elevator car and past the second elevator car to the first elevator car, and the second traction means is guided between the second drum and the first end of the second traction means to the second elevator car.

4. The elevator system according to claim 3 wherein the first traction means is guided between the first drum and the first end of the first traction means along the second longitudinal side of the first elevator car and the second traction means is guided between the second drum and the first end of the second traction means along the first longitudinal side of the second elevator car.

5. The elevator system according to claim 1 wherein the first end of the second traction means is connected at an area of an underside of the first elevator car, and the first end of the second traction means is connected at an area of an underside of the second elevator car.

6. The elevator system according to claim 1 wherein the adjustment device includes a first pulley on which the first traction means is guided between the first drum and the first end of the first traction means, and a second pulley on which the second traction means is guided between the second drum and the first end of the second traction means.

7. The elevator system according to claim 1 wherein the first traction means is wound from below around the first drum and the second traction means is wound from below around the second drum.

8. The elevator system according to claim 1 wherein the first traction means is wound from above around the first drum and the second traction means is wound from above around the second drum.

9. The elevator system according to claim 1 including a further adjustment device having a third drum and a fourth drum arranged on the elevator car carrier, a third traction means wound onto the third drum, and a fourth traction means wound onto the fourth drum in an opposite sense to the third traction means.

10. The elevator system according to claim 9 wherein a first end of the third traction means is connected to the first elevator car, a second end of the third traction means is connected to the third drum, a first end of the fourth traction means is connected to the second elevator car, and a second end of the fourth traction means is connected to the fourth drum.

11. The elevator system according to claim 10 wherein the third drum and the fourth drum are driven in rotation by the drive unit.

12. The elevator system according to claim 9 wherein the third traction means is wound from below around the third drum and the fourth traction means is wound from below around the fourth drum.

13. The elevator system according claim 9 wherein the third traction means is wound from above around the third drum and the fourth traction means is wound from above around the fourth drum.

* * * * *